US006440653B2

(12) United States Patent
Fyson et al.

(10) Patent No.: US 6,440,653 B2
(45) Date of Patent: Aug. 27, 2002

(54) METHOD OF PRODUCING A PHOTOGRAPHIC IMAGE

(75) Inventors: John R. Fyson, London (GB); Louis E. Friedrich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/852,368

(22) Filed: May 10, 2001

(30) Foreign Application Priority Data

Jun. 28, 2000 (GB) ..... 0015893

(51) Int. Cl.[7] ..... G03C 7/30

(52) U.S. Cl. ..... 430/403; 430/373; 430/393; 430/414; 430/430; 430/455; 430/943

(58) Field of Search ..... 430/403, 373, 430/393, 414, 430, 455, 943

(56) References Cited

U.S. PATENT DOCUMENTS

| | | | | |
|---|---|---|---|---|
| 3,869,288 A | | 3/1975 | Godowsky | 430/383 |
| 5,171,658 A | * | 12/1992 | Fyson | 430/393 |
| 5,200,302 A | | 4/1993 | Iwano | 430/376 |
| 5,246,822 A | | 9/1993 | Evans et al. | 430/429 |
| 5,441,843 A | | 8/1995 | Hara | 430/138 |
| 5,477,301 A | | 12/1995 | Earle et al. | 354/325 |
| 5,670,300 A | * | 9/1997 | Fyson et al. | 430/373 |
| 5,702,874 A | * | 12/1997 | Fyson et al. | 430/373 |
| 5,834,156 A | * | 11/1998 | Urasaki et al. | 430/403 |
| 5,834,165 A | * | 11/1998 | Hirabayashi | 430/372 |
| 5,876,906 A | * | 3/1999 | Fyson et al. | 430/455 |
| 5,910,397 A | * | 6/1999 | Feumi-Jantou et al. | 430/943 |
| 6,060,225 A | * | 5/2000 | Makuta | 430/405 |

* cited by examiner

*Primary Examiner*—Hoa Van Le

(57) ABSTRACT

A method of producing a photographic image in an image-wise exposed photographic material comprising one or more silver halide emulsion layers comprises developing the material with a developer solution containing a silver halide developing agent, applying to the surface of the developed material a solution of a sulphite compound that reacts with oxidised developing agent and prevents further development, and applying to the surface of the developed material a solution of an oxidant that oxidises any remaining developing agent, wherein said sulphite compound is present in an amount sufficient to react with all the oxidised developing agent and said solutions of sulphite and oxidant are applied to the material by means other than immersion in a tank.

10 Claims, 1 Drawing Sheet

METHOD OF PRODUCING A PHOTOGRAPHIC IMAGE

FIELD OF THE INVENTION

This invention relates to the processing of photographic materials. In particular, the invention simplifies the chemical processing of silver halide materials and reduces the volumes of liquid processing solutions employed.

BACKGROUND OF THE INVENTION

Normally, silver halide materials are processed in equipment with deep tanks containing processing solutions. The solutions need to be maintained in a chemically stable state to the extent that uniformity and consistency of photographic results are assured.

The effects of evaporation, interaction with atmospheric gases such as oxygen and carbon dioxide, and the effects of processing usually have to be compensated for by replenishment techniques. This requires operator intervention and/or the provision of additional solutions and means of adding them accurately. Also liquid effluent is produced which has to be disposed of in a safe and cost-effective way. Such wet chemical systems are generally difficult to keep clean.

Low silver materials have been described which use small fractions of the amount of silver needed to provide the oxidation of developer resulting from development of the silver halide crystals when that oxidised developer is used to provide the image dye via reaction with colour-forming couplers. These low silver materials are processed in the presence of oxidising agents such as hydrogen peroxide in development amplification processes commonly referred to as Redox Amplification or RX processes. In such processes the developed silver image is used to catalyse in an image-wise manner, the production of oxidised developer and hence, image dye. Such materials are appropriate for print production.

It is possible to leave the developed silver in the image with little effect on image quality when very low amounts of silver halide are used (Research Disclosure, September 1997, p.638 ). It has also been suggested that it is possible to leave the silver halide in non-image areas. The silver halide can be stabilised to degradation by light, for example, by destroying the silver halide spectral sensitising dyes by exposure to light ( U.S. Pat. No. 5,441,843 ) or by converting the silver halide to a more stable form such as silver iodide ( U.S. Pat. No. 5,246,822).

After processing, the material has to be washed to remove materials generated during the processing and to remove excess colour developing agent and hydrogen peroxide which would cause coloration of the material with time.

Single-use processing systems have been described (Research Disclosure, September 1997, p.638). These can involve the application of solutions to the surface of materials in a way which results in a uniform or image-wise amount of solution being applied. The uniform application of developer to the surface of colour negative paper using ink-jet methods has been described EP Application No. 94201050.5. U.S. Pat. No. 3,869,288 describes the separate application of developer solution components by spraying droplets. U.S. Pat. No. 5,200,302 describes a method of processing involving coating developer to produce a film of processing solution of thickness "at most 20×" that of the dry gel thickness. Uniform application results in low density areas being treated with the same chemical amounts as maximum density areas. When limited amounts of solutions are applied, there is limited opportunity to use the solutions to remove chemicals which are unused or which are generated or released during processing.

A method of removal of organic materials, which does not involve washing the processed materials has been described in PCT GB99/04319. The method involves the use of carbon coated in a gelatin layer on a suitable support. The coating is laminated with the processed material and the carbon used to adsorb the undesirable chemicals which are consequently extracted from the processed material. The amounts of soluble dyes used for sharpness control and the unused colour developer were reduced to low levels by this method.

Problem to be Solved by the Invention

Wet chemical systems of processing are complicated in order to maintain at a consistent performance level. Also, they are difficult to keep clean. They produce liquid effluent that requires disposal. They usually consist of several treatments in different chemical baths plus a washing or stabilisation stage which is used to remove chemicals which would, if remaining in the image, modify the image over time. The problem to be solved is to provide a means of processing photographic material in a simple process which minimises liquid effluent while ensuring the removal of oxidisable organic chemicals, such as colour developing agents, and peroxide which would otherwise modify the images over a period of time.

SUMMARY OF THE INVENTION

The present invention provides a method of producing a photographic image in an imagewise exposed photographic material comprising one or more silver halide emulsion layers which method comprises developing the material with a developer solution containing a silver halide developing agent, applying to the surface of the developed material a solution of a sulphite compound that reacts with oxidised developing agent and prevents further development, and applying to the surface of the developed material a solution of an oxidant that oxidises any remaining developing agent, wherein said sulphite compound is present in an amount sufficient to react with all the oxidised developing agent and said solutions of sulphite and oxidant are applied to the material by means other than immersion in a tank.

Advantageous Effect of the Invention

The method of the invention eliminates the need for a wash step after development. No water needs to be supplied or removed from the processor.

The method reduces the number of processing tanks required by avoiding the need for stabiliser and/or wash tanks.

A very low volume of liquid can be employed and the method can be used substantially without effluent being produced.

Developer or developer/amplifier reaction is stopped.

Colour developing agent and/or peroxide are destroyed so that the colour developing agent does not couple with any unused couplers in the material.

The photographic material e.g. paper is stabilised.

DETAILED DESCRIPTION OF THE INVENTION

Figure 1:
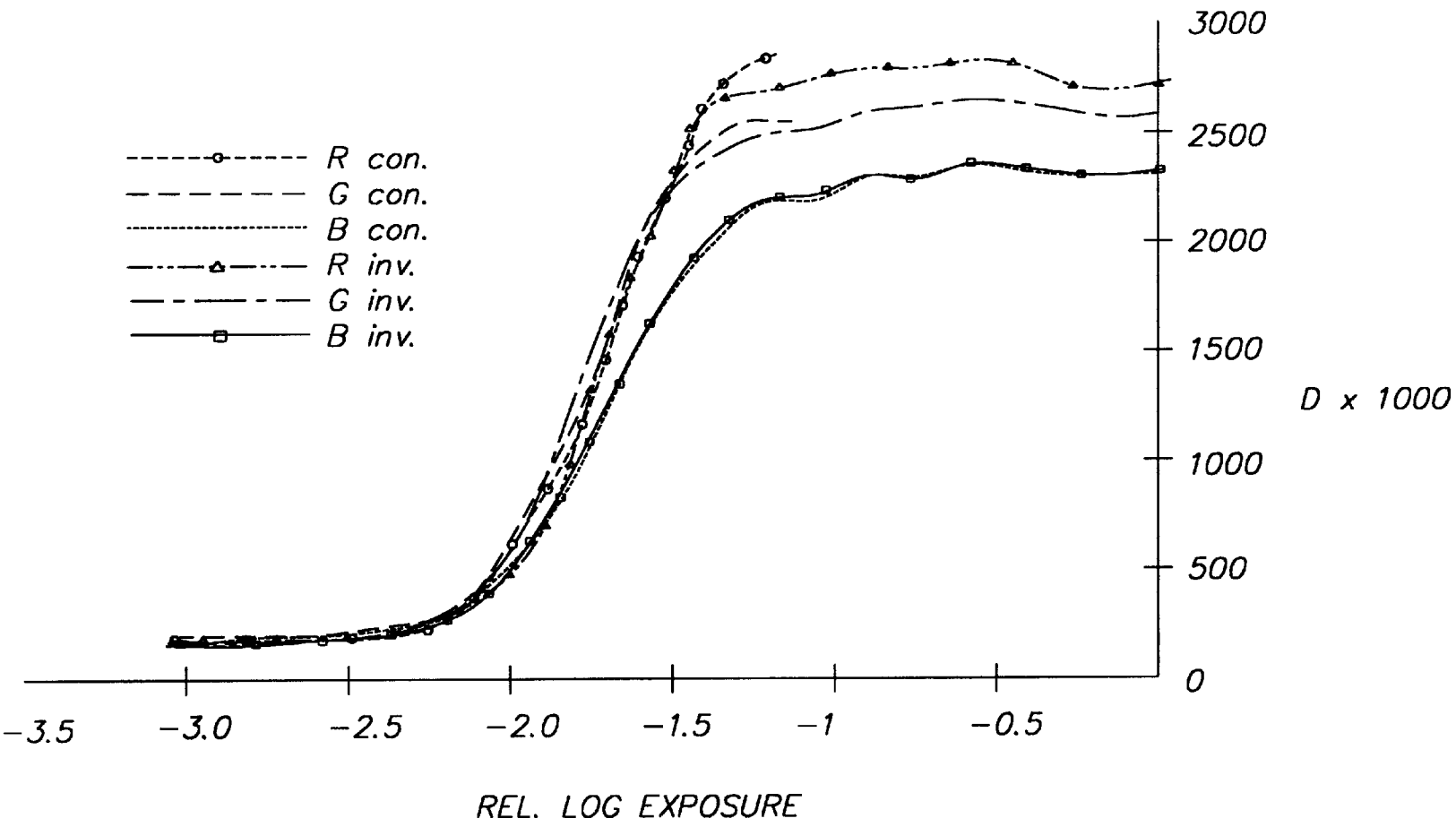
FIG. 1 shows densitometric curves for materials processed in accordance with the invention following the procedure of Example 2.

The photographic material used in the method of the invention may be any black and white or colour silver halide material. In a preferred embodiment, the material is a colour silver halide material e.g. a colour print or film material. In colour photographic materials, dye images can be formed by reaction of oxidised developer with image dye forming couplers. A preferred class of developing agents for chromogenic colour development is the paraphenylene diamine class.

A preferred form of photographic processing is redox amplification also known as development amplification. It is an advantage of the development amplification process that a low silver material can be employed. Low silver materials typically contain less than 400 mg/m$^2$, preferably less than 200 mg/m$^2$ silver.

Preferably, the sulphite compound is a hydrogen sulphite or metabisulphite compound. Examples of suitable compounds include soluble alkali metal, alkaline earth metal or ammonium hydrogen sulphites and metabisulphites e.g. sodium hydrogen sulphite and sodium metabisulfite.

The solution of the sulphite compound may contain the sulphite compound in an amount from 0.02 to 1 mole/l, preferably from 0.15 to 0.5 mole/l.

Preferably, the oxidant is a salt of a peroxy sulphuric acid such as eroxymonosulphuric acid ($H_2SO_5$) or peroxydisulphuric acid ($H_2S_2O_8$). Salts of peroxydisulphuric acid are often simply referred to as persulphates. Examples of suitable compounds include soluble alkali metal, alkaline earth metal or ammonium peroxymonosulphates and persulphates e.g. sodium peroxymonosulphate and sodium persulphate.

The solution of the oxidant may contain the oxidant in an amount from 0.02 to 1 mole/l, preferably from 0.15 to 0.5 mole/l. Preferably, the concentration of the oxidant is less than that of the sulphite compound.

It is preferred that the total amount of the solutions of sulphite and oxidant applied to the surface of the developed material does not exceed 100 ml/m$^2$. A preferred amount is from 20 to 60 ml/m$^2$.

The weight ratio of the solutions of sulphite and oxidant applied to the surface of the developed material may vary from 5:1 to 1:5. Preferably, the solutions are employed in substantially equal amounts.

Preferably, the total amount of the solutions of sulphite and oxidant is such that substantially no effluent is produced.

The solutions of sulphite and oxidant are applied to the material by means other than immersion in a tank. Examples of suitable means include spraying from a fine nozzle, an air brush, an ink jet head or by application with a roller. The roller may or may not have a surface pattern, or a roller covered with an adsorbent material such as felt or sponge may be used. If two separate applications are required it is preferable that the second solution is applied by a non-contact method such as spraying with a nozzle, an air-brush or an ink-jet head.

In a preferred embodiment, the solutions of sulphite and oxidant are applied to the material sequentially. Preferably, the oxidant solution is applied within 20 seconds, more preferably within 10 seconds of application of the sulphite solution.

In an alternative embodiment, the solutions of sulphite and oxidant are applied to the material simultaneously. If the solutions are mixed together before application, it is preferable to apply the mixture within 10 seconds of mixing.

An advantage of the method of the invention is that only very low volumes of sulphite and oxidant solution need be used. Preferably, the volumes of solution used are such that there is substantially no effluent created. A small volume of solution can be accommodated by the swell of the photographic material being treated. Additional solution can be accommodated on the surface of the material without creating effluent. Subsequent drying of the material removes the unwanted water.

The method of the invention is particularly desirable for processing colour photographic materials. The method involves applying in a controlled fashion to the material a colour developer scavenger i.e. the sulphite compound that reacts with oxidised colour developer in preference to the imaging couplers in the material. Then, the oxidant solution is applied in a controlled fashion. If necessary, the pH of these applied solutions is adjusted to ensure that the colour developer will not couple with the image dyes in the film but will react with the colour developer scavenger. Preferably, the oxidant is colourless and forms colourless harmless products or at least reacts to form colourless and harmless products.

In a particularly preferred embodiment of the invention, a soluble hydrogen sulphite (0.02–1.0 molar) or metabisulphite solution is applied to a developed colour photographic material by spray, airbrush or ink-jet head in an amount preferably, but not necessarily, less than the swell of the photographic material followed by applying a solution of persulphate of preferably, but not necessarily, lower concentration than the hydrogen sulphite solution and preferably, but not necessarily, in a similar amount to the hydrogen sulphite or metabisulphite solution.

The invention may be employed in processing any silver halide photographic material.

The photographic elements can be single colour elements or multicolour elements having a paper or a transparent film base. Multicolour elements contain dye image forming units sensitive to each of the three primary regions of the spectrum. Each unit can be comprised of a single emulsion layer or of multiple emulsion layers sensitive to a given region of the spectrum. The layers of the element, including the various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers. Suitable materials for use in this invention, can have any of the components described in Research Disclosure Item 36544, September 1994, published by Kenneth Mason Publications, Emsworth, Hants P010 7DQ, United Kingdom.

A description of typical photographic materials may be found in *Research Disclosure,* September 1997, p.613, Section I. Photographic processing steps such as development, bleaching and fixing together with the compositions used in those steps e.g. developing agents are described in, for example, *Research Disclosure,* September 1994, No.365, Sections XIX & XX and *Research Disclosure,* September 1997, p. 613, Section XXIII.

A preferred form of photographic processing is redox amplification also known as development amplification. Such processes are well known and details may be found in *Research Disclosure,* September 1997, p. 629–630, Section XVI.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, e.g. addition compounds of hydrogen peroxide or persulphates; cobalt (III) complexes including cobalt hexammine complexes; and periodates. Mixtures of such compounds can also be used.

In conventional processing (non-RX) of colour materials, separate bleach and fix baths or a bleach-fix bath which both bleaches silver image and removes all silver from the material may be employed. However, because of the small amounts of silver present in the photographic material used in RX processing, it is possible to leave out the processing stages that bleach and fix because the degradation of the image is minimal.

The invention is further illustrated by way of example as follows.

EXAMPLE 1

Unexposed Kodak Edge 7™ paper was processed through standard 'Prime'™ processing chemicals in a minilab. The couplers in this coating should remain uncoupled. Similarly, fully exposed Kodak Edge 7™ paper was processed in the same way.

Samples of this processed paper were dipped in Kodak Ektacolor 'Prime'™ developer for 5 seconds then squeegeed to remove any excess developer. A bisulphite solution was spayed on the surface with an airbrush to give a covering of about 20 ml/m$^2$. 10 s later a similar amount of persulphate solution was applied in the same way. The coating was allowed to stand for 1 minute. During this time the coating went pink and then returned to white. The coating was allowed to dry at room temperature and was then tested for the presence of colour developer with the following test using CD3 (4-N-ethyl-N-(βmethanesulphonamidoethyl)-o-toluidine sesqisulphate).

CD3 Test Solution

The following solution was used as a test solution for retained colour developing agent in photographic paper:

| | |
|---|---|
| potassium hexacyanoferrate (III) | 25 g |
| sodium carbonate | 25 g |
| water to | 1 liter |

The solution was applied as a spot to the dried treated area of paper and left for 1 minute. The whole paper was washed and dried and the density of the spotted area measured and compared to a spot place on untreated paper that had not been dipped in developer, the control C1, and also with paper that was treated by two sprays of demineralised water after being dipped in developer, control C2.

Results

The results of the originally unexposed paper are shown in Table 1.

TABLE 1

| persulfate (g/l) | C1 | C2 | 5 | 5 | 5 | 10 | 20 |
|---|---|---|---|---|---|---|---|
| ABS (g/l) | | | 30 | 40 | 50 | 50 | 100 |
| D red | 0.12 | 1.24 | 0.12 | 0.12 | 0.12 | 0.11 | 0.11 |
| D green | 0.15 | 1.25 | 0.16 | 0.14 | 0.14 | 0.14 | 0.14 |
| D blue | 0.33 | 0.80 | 0.33 | 0.30 | 0.30 | 0.30 | 0.28 |

The results show that there is a large stain in C2 caused by residual developer being oxidised by the test solution and coupling with ionised coupler in the paper. Paper that had not been dipped in developer had higher than expected blue density, probably due to some reaction with another component in the paper. The invention was shown with the other test solutions. The densities of all these were similar to those of C1 showing that the colour developer had been destroyed.

The results of the test with the filly exposed paper are shown in Table 2.

TABLE 2

| persulfate (g/l) | C1 | 5 | 5 | 5 | 10 |
|---|---|---|---|---|---|
| ABS (g/l) | | 30 | 40 | 50 | 100 |
| D red | 2.78 | 2.79 | 2.81 | 2.75 | 2.80 |
| D green | 2.69 | 2.69 | 2.70 | 2.65 | 2.69 |
| D blue | 2.44 | 2.36 | 2.37 | 2.36 | 2.35 |

The results indicate that the treatment solution does not destroy the dye.

EXAMPLE 2

In the following combined development/amplification solution, Anti-Cal #5 is 1-hydroxy-ethylidene-1,1-diphosphonic acid and Anti-Cal #8 is diethylenetriamine-pentaacetic acid, pentasodium salt.

| | |
|---|---|
| Devamp Solution: | |
| Anti-Cal #5 | 0.5 g |
| Anti-Cal #8 | 0.8 g |
| dipotassium hydrogen phosphate | 40 g |
| hydroxylammonium sulphate (HAS) | 1.3 g |
| CD3 | 5.5 g |
| potassium chloride | 0.5 g |
| hydrogen peroxide (30%) | 2.7 g |
| pH adjusted to | 11.5 |
| Fix Solution: | |
| sodium thiosulphate | 50 g |
| acetic acid | 10 ml |

-continued

| | |
|---|---|
| water to | 1 liter |
| Bisulphite Solution | |
| sodium bisulphite | 25 g |
| water to | 1 liter |
| Persulphate Solution | |
| sodium persulphate | 5 g |
| water to | 1 liter |

Low silver paper (84 mg/m$^2$) was exposed through a neutral wedge for 1/10 s on a sensitometer.

One strip was processed at 35° C. as the control as follows:

| | |
|---|---|
| Devamp | 45 s |
| Fix | 45 s |
| Wash (running water) | 120 s |
| Dry at room temperature | |

Another strip was processed in the devamp solution for 45 s at 35° C. then passed under an airbrush such that 20 ml/m$^2$ bisulphite solution was laid down. Approximately 10 s later the strip was passed under another airbrush and 20 ml/m$^2$ of the persulphate solution was laid down. The strip was left to dry at room temperature.

The two strips were read with densitometer (status A) and the curves compared, see FIG. 1.

It can be seen that the sensitometry is very similar.

The invention has been described in detail with particular reference to certain preferred embodiments thereof, but it will be understood that variations and modifications can be effected within the spirit and scope of the invention.

What is claimed is:

1. A method of producing a photographic image in an imagewise exposed photographic material comprising one or more silver halide emulsion layers which method comprises developing the material with a developer solution containing a silver halide developing agent, applying to the surface of the developed material a solution of a sulphite compound that reacts with oxidised developing agent and prevents further development, and applying to the surface of the developed material a solution of an oxidant that oxidises any remaining developing agent, wherein said sulphite compound is present in an amount sufficient to react with all the oxidised developing agent and said solutions of sulphite and oxidant are applied to the material by means other than immersion in a tank.

2. A method as claimed in claim 1 wherein the photographic material is a colour photographic material.

3. A method as claimed in claim 1 wherein development is accompanied by an amplification step.

4. A method as claimed in claim 1 wherein the sulphite compound is a hydrogen sulphite or metabisulphite compound.

5. A method as claimed in claim 1 wherein the sulphite compound is present in an amount from 0.02 to 1 mole/l.

6. A method as claimed in claim 1 wherein the oxidant is a salt of a peroxy sulphuric acid.

7. A method as claimed in claim 1 wherein the oxidant is present in an amount from 0.02 to 1 mole/l.

8. A method as claimed in claim 1 wherein said solutions of sulphite and oxidant are applied to the material by spraying from a fine nozzle, an air brush, an ink jet head or by application with a roller.

9. A method as claimed in claim 1 wherein the total amount of said solutions of sulphite and oxidant applied to the surface of the developed material does not exceed 100 ml/m$^2$.

10. A method as claimed in claim 1 wherein the total amount of said solutions of sulphite and oxidant applied to the surface of the developed material is from 20 to 60 ml/m$^2$.

* * * * *